US009713375B1

(12) United States Patent
Rahm

(10) Patent No.: US 9,713,375 B1
(45) Date of Patent: Jul. 25, 2017

(54) COLLAPSIBLE PORTABLE TABLE

(71) Applicant: Brett Einar Rahm, Pittsville, WI (US)

(72) Inventor: Brett Einar Rahm, Pittsville, WI (US)

( * ) Notice: Subject to any disclaimer, the term of this patent is extended or adjusted under 35 U.S.C. 154(b) by 0 days.

(21) Appl. No.: 15/051,572

(22) Filed: Feb. 23, 2016

Related U.S. Application Data

(60) Provisional application No. 62/121,210, filed on Feb. 26, 2015.

(51) Int. Cl.
*A47B 3/091* (2006.01)
*A47B 3/00* (2006.01)

(52) U.S. Cl.
CPC ..... *A47B 3/0911* (2013.01); *A47B 3/002* (2013.01)

(58) Field of Classification Search
CPC ..... A47B 3/02; A47B 9/16; A47B 2003/025
USPC ..... 108/118, 119, 120, 115
See application file for complete search history.

(56) References Cited

U.S. PATENT DOCUMENTS 646,705 A * 4/1900 Kummerow ..... A47B 3/02 108/118
1,152,987 A * 9/1915 Spalding ..... A47B 3/02 108/118
1,487,144 A * 3/1924 Callaway ..... D06F 81/02 108/118
1,591,519 A * 7/1926 Dorau ..... D06F 81/02 108/118
1,608,924 A * 11/1926 Brown ..... A47B 3/02 108/118
2,471,564 A * 5/1949 Gaudette ..... A47B 3/02 108/118
2,557,594 A * 6/1951 Bryan ..... A47B 3/02 108/118
2,579,783 A 12/1951 Branto
2,601,357 A * 6/1952 Allbritton ..... A47B 3/02 108/118
2,652,299 A * 9/1953 Bryan ..... A47B 3/02 108/118
2,695,829 A * 11/1954 Martinez ..... A47B 3/02 108/118
2,716,582 A * 8/1955 Rosenfeld ..... A47B 3/12 108/118
2,902,325 A 9/1959 Knoblock et al.
2,932,343 A 4/1960 Brut
3,062,603 A * 11/1962 Kamenstein ..... A47B 3/02 108/116
3,080,202 A 3/1963 Franzene
3,240,170 A 3/1966 Shave
(Continued)

*Primary Examiner* — Jose V Chen
(74) *Attorney, Agent, or Firm* — Brannen Law Office, LLC

(57) ABSTRACT

The present invention relates to a collapsible portable table having a top, two pivot frames, a center leg frame and two outer legs. An end support is at each end of a lower surface of the top. A center support is centrally aligned on the lower surface and two pivot supports are provided. Each of the pivot frames is pivotally connected to one of the pivot supports. The center leg frame is pivotally connected to one pivot frame. The outer legs are pivotally connected to the other pivot frame. The pivot supports pivot approximately 180 degrees relative to the table top. The legs can be in a storage position wherein they are generally parallel to the table top. The legs can also be in a deployed position wherein the respective distal ends of the legs are separated by a distance with a midpoint generally aligned with a top midpoint.

18 Claims, 6 Drawing Sheets

(56) References Cited

U.S. PATENT DOCUMENTS

| | | | | | |
|---|---|---|---|---|---|
| 3,244,451 | A | | 4/1966 | Roy | |
| 3,298,328 | A | | 1/1967 | Hoodis | |
| 3,342,226 | A | | 9/1967 | Marcoux et al. | |
| 3,345,959 | A | | 10/1967 | Linstead | |
| 3,357,729 | A | | 12/1967 | Krueger | |
| 3,365,072 | A | | 1/1968 | Hill | |
| 3,646,895 | A | * | 3/1972 | Campbell | A47B 3/02 108/118 |
| 3,669,031 | A | | 6/1972 | Cole | |
| 3,954,068 | A | | 5/1976 | Roberts et al. | |
| 4,700,986 | A | | 10/1987 | Davis et al. | |
| D295,349 | S | | 4/1988 | Mueller | |
| 4,838,179 | A | | 6/1989 | Bing | |
| 4,974,525 | A | * | 12/1990 | Sheffield | A47B 3/02 108/118 |
| 5,335,604 | A | * | 8/1994 | Jiang | A47B 3/02 100/119 |
| 5,535,683 | A | | 7/1996 | Novak | |
| 5,762,004 | A | | 6/1998 | Vashon et al. | |
| 5,803,536 | A | | 9/1998 | Perzee et al. | |
| 5,927,436 | A | * | 7/1999 | Schutz | B25H 1/04 108/118 |
| 6,053,116 | A | | 4/2000 | Jung et al. | |
| 6,145,800 | A | | 11/2000 | Watkins | |
| 6,523,485 | B1 | | 2/2003 | Cipolla | |
| 6,779,466 | B2 | | 8/2004 | Shabram, Jr. | |
| 7,063,025 | B2 | | 6/2006 | Ashby et al. | |
| 7,263,932 | B2 | | 9/2007 | Winter et al. | |
| 7,287,730 | B1 | * | 10/2007 | Chen | B25H 1/04 108/118 |
| 7,475,640 | B2 | | 1/2009 | Winter et al. | |
| 7,681,267 | B1 | | 3/2010 | Hall | |
| 7,752,982 | B2 | | 7/2010 | Lin | |
| 7,950,337 | B2 | | 5/2011 | Chen | |
| 8,188,410 | B2 | | 5/2012 | Dean et al. | |
| 8,424,464 | B2 | | 4/2013 | Korpi | |
| 8,528,489 | B2 | | 9/2013 | Roy et al. | |
| 8,555,790 | B2 | | 10/2013 | Winter et al. | |
| 8,667,907 | B2 | | 3/2014 | Grace | |
| 8,857,350 | B2 | | 10/2014 | Carter | |
| 8,950,343 | B2 | * | 2/2015 | Huang | A47B 9/16 108/116 |
| 2003/0079661 | A1 | | 5/2003 | Luu | |
| 2004/0094076 | A1 | | 5/2004 | Jin | |
| 2004/0123780 | A1 | | 7/2004 | Butts, Jr. | |
| 2005/0005826 | A1 | | 1/2005 | Strong et al. | |
| 2007/0175369 | A1 | * | 8/2007 | Reiner | A47B 3/02 108/118 |
| 2007/0221104 | A1 | * | 9/2007 | Tseng | A47B 3/02 108/118 |
| 2007/0234934 | A1 | | 10/2007 | Branch et al. | |
| 2008/0196636 | A1 | | 8/2008 | Lawrence | |
| 2009/0272299 | A1 | | 11/2009 | Rios et al. | |
| 2009/0293778 | A1 | | 12/2009 | Branch | |
| 2011/0048288 | A1 | | 3/2011 | Sheldon | |
| 2014/0090582 | A1 | | 4/2014 | Grace | |

* cited by examiner

COLLAPSIBLE PORTABLE TABLE

This United States utility patent application claims priority on and the benefit of provisional application No. 62/121,210 filed Feb. 26, 2015, the entire contents of which are hereby incorporated herein by reference.

BACKGROUND OF THE INVENTION

1. Field of the Invention

The present invention relates to a collapsible portable table, and in particular to a collapsible portable table having pivot frames.

2. Description of the Related Art

Many tables exist. Some tables are collapsible and portable. A couple of examples are:

United States Patent Number ("USPN") U.S. Pat. No. 7,475,640 to Winter, et al. is titled Personal Table. It shows a personal table that is provided having a table top supported by a support assembly. The table top is preferably constructed from blow-molded plastic and the support assembly preferably includes a first leg and a second leg that are pivotally connected. The legs desirably have a generally X-shaped configuration when the legs are placed in an upright position and the legs can be collapsed into a storage position. Each of the legs may include a lower portion, a body portion and an upper portion that is preferably selectively connected to the table top. The legs, for example, can be connected to the table top by inserting the upper portions of the legs into leg receiving recesses formed in the table top. The leg receiving recesses are preferably integrally formed in the bottom surface of the table top as part of a one-piece construction. Desirably, a plurality of leg receiving recesses are formed in the bottom surface of the table top and the legs can be selectively attached to the leg receiving recesses in order to vary the height of the table.

U.S. Pat. No. 7,063,025 to Ashby, et al. is titled Table with Foldable Legs. It shows a table that may include a table top, a frame and one or more legs. The legs are preferably pivotally attached to the frame by brackets and the brackets may be rotatable with respect to the table top. The table may also include a drawer and the legs may be sized and configured to be disposed about the drawer when the legs are in a collapsed position. In addition, one or more links may be used to connect the brackets to the frame, if desired.

Neither of these patents shows the unique advantages of the present invention.

SUMMARY OF THE INVENTION

The present invention relates to a collapsible portable table having a top, two pivot frames, a center leg frame and two outer legs. An end support is at each end of a lower surface of the top. A center support is centrally aligned on the lower surface and two pivot supports are provided. Each of the pivot frames is pivotally connected to one of the pivot supports. The center leg frame is pivotally connected to one pivot frame. The outer legs are pivotally connected to the other pivot frame. The pivot supports pivot approximately 180 degrees relative to the table top. The legs can be in a storage position wherein they are generally parallel to the table top. The legs can also be in a deployed position wherein the respective distal ends of the legs are separated by a distance with a midpoint generally aligned with a top midpoint.

According to one advantage of the present invention, the table is sturdy. This is accomplished by using pivoting mechanisms that avoid slots and channels through which components could slip.

According to another advantage of the present invention, the table is collapsible to a low profile or height in a storage position. The legs are generally aligned parallel to the top in the storage position minimizing storage height. This advantageously allows the table to be stored under furniture such as sofas or beds.

According to another advantage of the present invention, pivot frames are provided and are pivotally connected to the pivot supports on the under surface of the table top. The pivot frames lay flat and generally parallel to the top in both the storage position and a deployed position. This advantageously minimizes height in the storage position. This also provided a fixed stop (i.e. the lower surface of the top) for the pivot frames when in the deployed position.

According to a still further advantage of the present invention, the legs are pivotally connected to the respective pivot frames. This allows the legs to be deployed and retracted without slots or other sliding types of engagements between components (which may be susceptible to binding or otherwise locking up relative to each other). It is understood that the leg proximal ends orbit in respective paths between the storage and deployed positions (orbit path defined by pivot frame).

According to a still further advantage yet of the present invention, the legs of the center leg frame are shorter than the legs of the outer legs. This advantageously allows the legs to be retracted to the storage position wherein they lay flat against the bottom surface of the top and without interference from each other.

All of the legs are shorter than the longitudinal length of the top. This advantageously allows the legs to be within the outer perimeter of the top when in the storage position.

According to a still further advantage yet of the present invention, supports are provided on the bottom surface. The legs and pivot frames, when the table is retracted, have lower surfaces that are in a plane with lower surfaces of the supports. This allows for flat storage.

According to a still further advantage of the present invention, the pivotal connections are made at the geometric center of the adjacent supports. This allows for the lower surfaces of the components to lay flat when the table is in the storage position.

According to a still further advantage yet of the present invention, the legs of the center leg frame each have a center leg frame distal end and the legs of the outer legs each have an outer leg distal end. When deployed, there is a distance between the center frame leg distal end and the outer leg distal end having a leg midpoint there between. The leg midpoint is generally aligned with a table center point. This advantageously results in an evenly supported table along the table longitudinal axis.

According to a still further advantage of the present invention, the legs of the center leg frame are pivotally connected to the outer legs. This is accomplished in a manner wherein the pivotal connection is longitudinally offset from the table top center to compensate for the differences in leg lengths.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
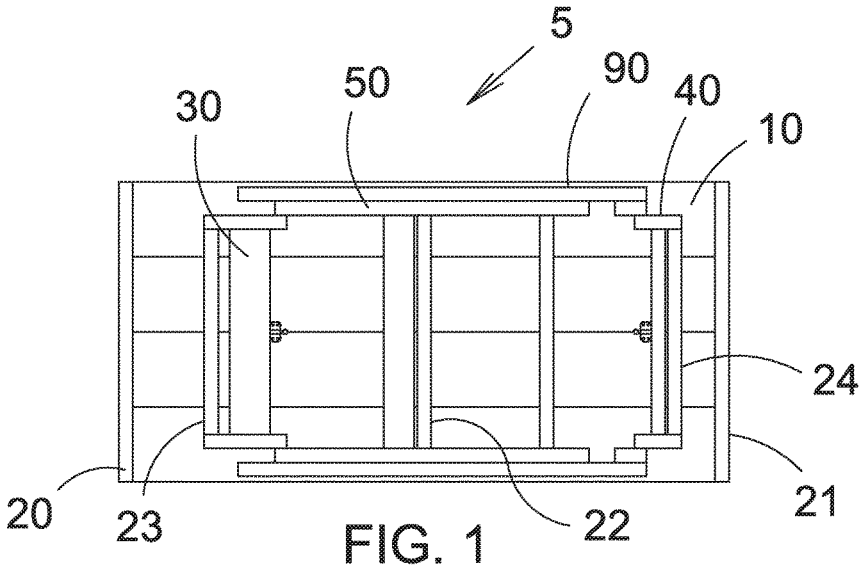
FIG. 1 is a bottom view showing a preferred embodiment of the present invention in a deployed position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is illustrated in FIGS. 1-14. Accordingly a table 5 is shown having a top 10, two pivot frames 30 and 40, respectively, a center leg frame 50 and outer legs 90. Each of these components are described below. One preferred material is wood. Yet, it is understood that other materials could be used without departing from the broad aspects of the present invention. In a preferred embodiment, the top 10 has a main body with a thickness of about ⅜ inch. The other components preferably have a thickness of about ⅞ inch.

Figure 5:
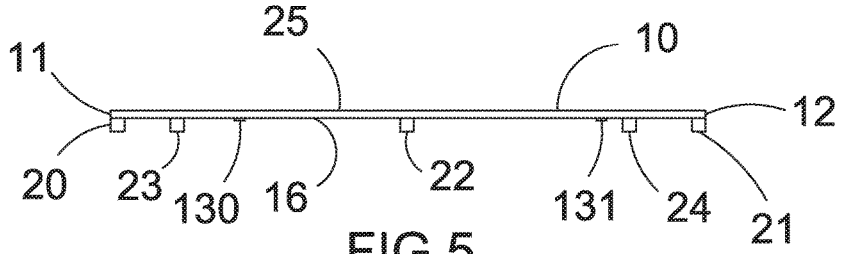
FIG. 5 is an isolated side view of the top illustrated in FIG. 1.
Figure 6:
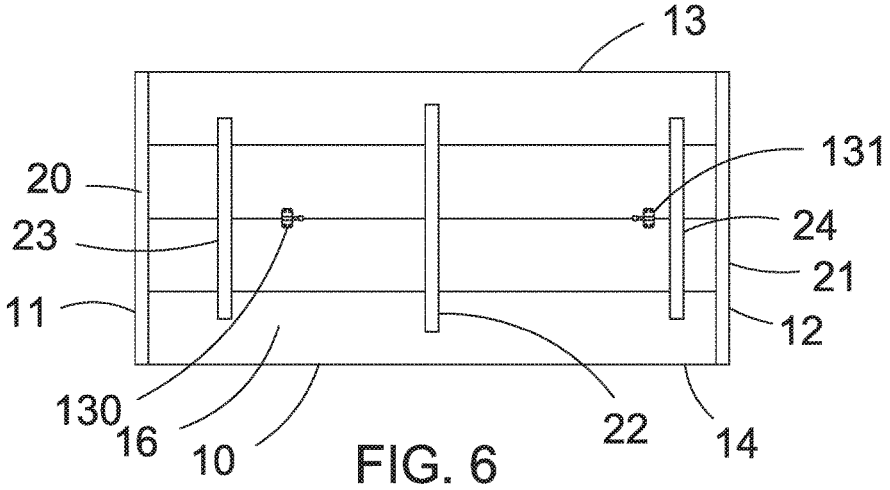
FIG. 6 is a bottom view of the top illustrated in FIG. 5.

The top 10 has a first end 11 and a second end 12, as seen in an isolation view in FIGS. 5 and 6. The top 10 also has opposed sides 13 and 14, an upper surface 15 and a lower surface 16. In a preferred embodiment, the top surface is approximately 18×36 inches. Of course, these dimensions could be changed without departing from the broad aspects of the present invention. The top surface 15 lies in a top surface plane.

An end support 20 is provided at end 11 of the top on the bottom surface 16. An end support 21 is provided at end 12 of the top on the bottom surface 16. A center support 22 is provided at the midpoint between ends 20 and 21 on the bottom surface 16 of the top 10. A first pivot support 23 is between the first end support 20 and the center support 22. A second pivot support 24 is between the second end support 21 and the center support 22. The supports 20-24 are part of the top 10. The supports depend opposite of the top surface 15 a distance to allow for pivotal connections. The supports are generally parallel to each other and each support has a respective axis. It is appreciated that the supports could alternatively be pairs of separated structures such as ears, knobs, eyelets or other structures without departing from the broad aspects of the present invention.

Figure 7:
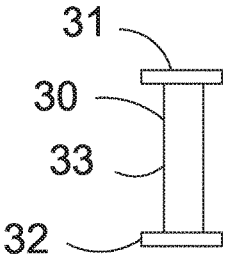
FIG. 7 is a bottom view showing the first pivot frame illustrated in FIG. 1.

The first pivot frame 30 has two flanges 31 and 32 that are separated by a web 33 as seen in an isolation view in FIG. 7. In this regard, the frame 30 has a general I-shaped profile. One of the flanges 31 and 32 is pivotally attached to each end of the first pivot support 23, respectively. The first pivot frame 30 can be rotated or pivoted approximately 180 degrees relative to the first pivot support 23. In this regard, the first pivot frame 30 can be outward oriented wherein it is between the first end support 20 and the first pivot support 23, or inward oriented wherein it is between the center support 22 and the first pivot support 23. In both the inward and outward positions, the pivot frame 30 is generally parallel to the top 10 and is positioned against the bottom surface 16 of the top.

Figure 8:
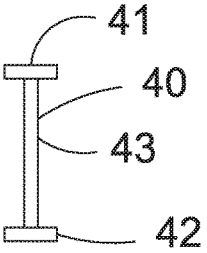
FIG. 8 is a bottom view showing the second pivot frame illustrated in FIG. 1.

The second pivot frame 40 has two flanges 41 and 42 that are separated by a web 43 as seen in an isolation view in FIG. 8. In this regard, the frame 40 has a general I-shaped profile. One of the flanges 41 and 42 is pivotally attached to each end of the second pivot support 24, respectively. In this regard, the second pivot frame 40 can be outward oriented wherein it is between the second end support 21 and the second pivot support 24, or inward oriented wherein it is between the center support 22 and the second pivot support 24. In both the inward and outward positions, the pivot frame 40 is generally parallel to the top 10 and is positioned against the bottom surface 16 of the top.

Figure 9:
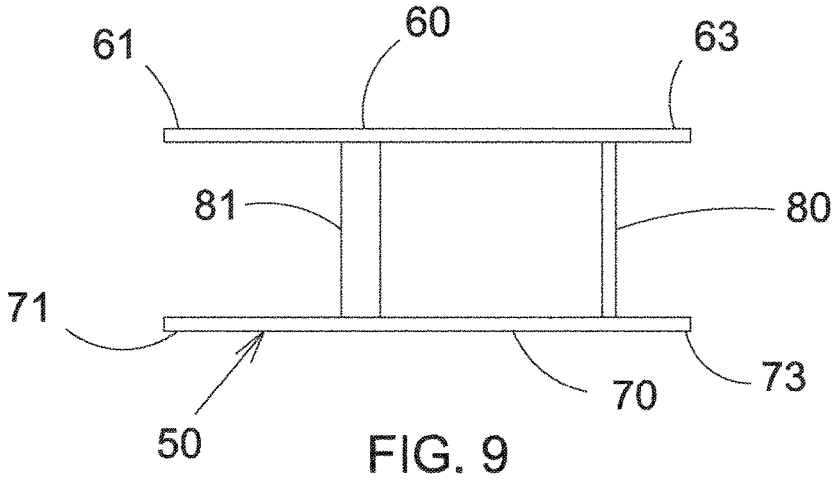
FIG. 9 is a bottom view showing the center leg frame illustrated in FIG. 1.

The center leg frame 50 has two legs 60 and 70 as seen in an isolation view in FIG. 9. Leg 60 has a proximal end 61 and a distal end 63. Leg 70 has a proximal end 71 and a distal end 73. Two cross members 80 and 81 are provided to interconnect legs 60 and 70. The legs 60 and 70 are generally parallel to each other. The center leg frame 50 is pivotally connected to the first pivot frame 30.

Figure 10:
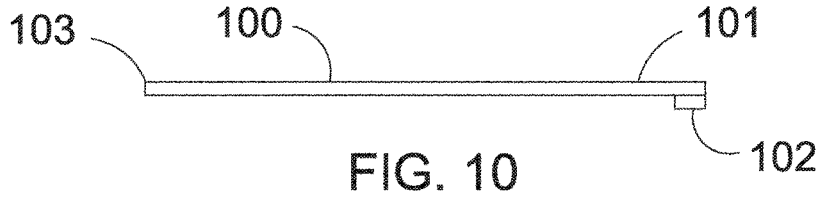
FIGS. 10 and 10A are bottom views of the outer legs illustrated in FIG. 1.
Figure 10A:
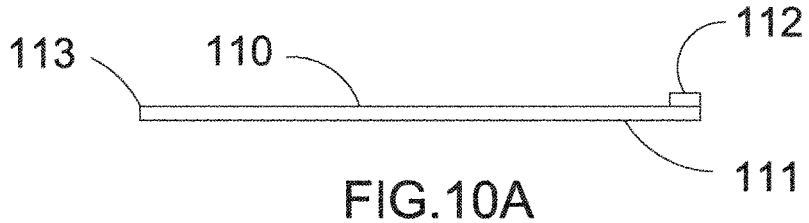
Figure 11:
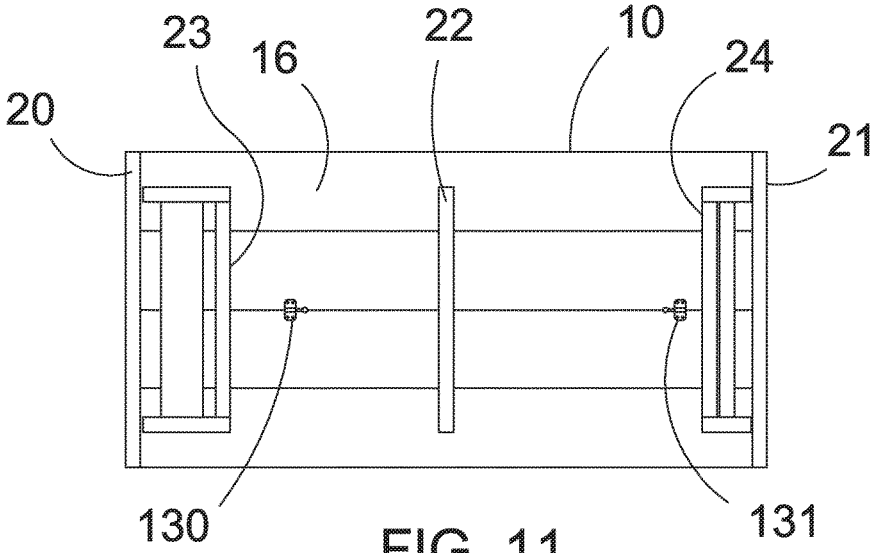
FIG. 11 is a bottom view showing the top and two pivot frames shown in the storage position.
Figure 12:
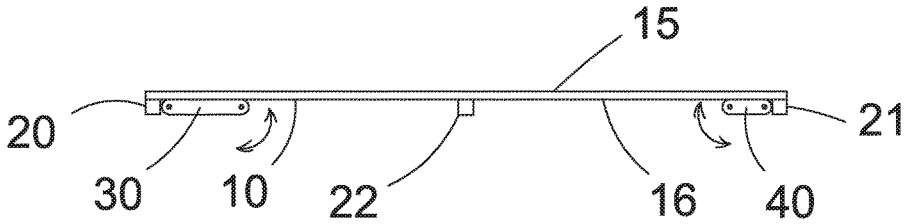
FIG. 12 is a side view of FIG. 11.
Figure 13:
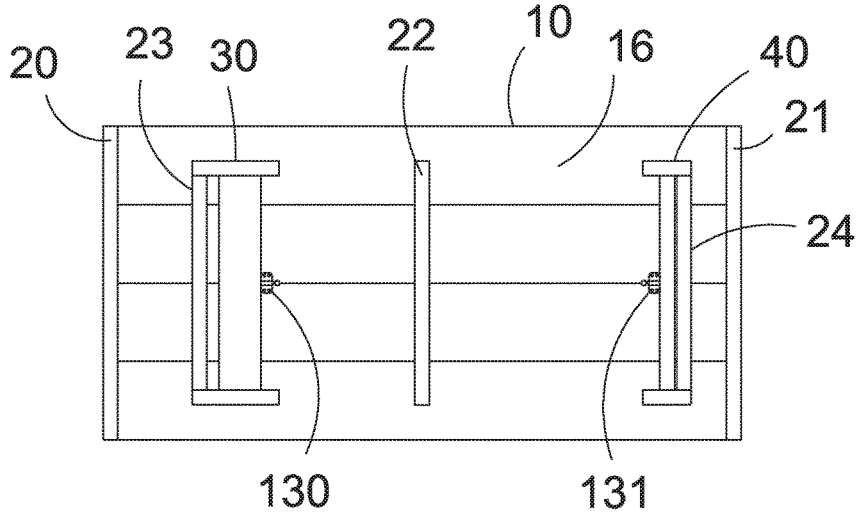
FIG. 13 is a bottom view showing the top and two pivot frames shown in the deployed position.
Figure 14:
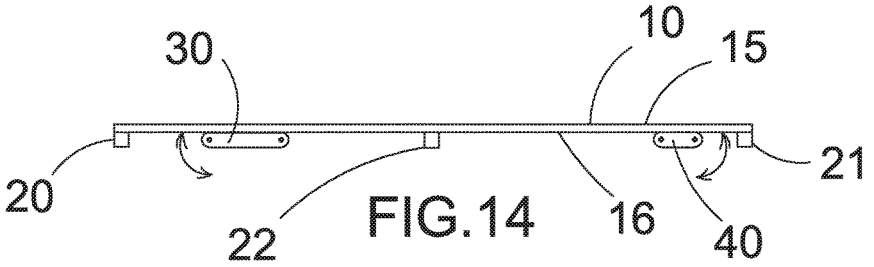
FIG. 14 is a side view of FIG. 13.

Outer legs 90 have two legs 100 and 110, each as seen in a respective isolation view in FIGS. 10 and 10A. The first outer leg 100 has a proximal end 101 with an ear 102 attached thereto, and a distal end 103. The second outer leg 110 has a proximal end 111 with an ear 112 attached thereto, and a distal end 113. Legs 100 and 110 are generally parallel to each other. The outer legs 90 are pivotally connected to the second pivot frame 40.

The first center leg 60 is pivotally connected to the first outer leg 100. The second center leg 70 is pivotally connected to the second outer leg 110. The center legs are generally shorter than the outer legs.

The pivotal connections described above and below are general made with fasteners 120. The fasteners can be pins, bolts, screws or any other type of device that allows componentry to be fastened together in a pivotal manner.

Ears 102 and 112 are provided so that the outer legs 100 and 110 are offset from the center legs 60 and 70, respectively so that they clear each other when pivoting relative to each other.

Two locks 130 and 131 are provided. Lock 130 can removably lock pivot frame 30 in an inward position. Lock 131 can removably lock pivot frame 30 in an inward position. This prevents the frames from moving if the table is unbalanced or moved.

Figure 2:
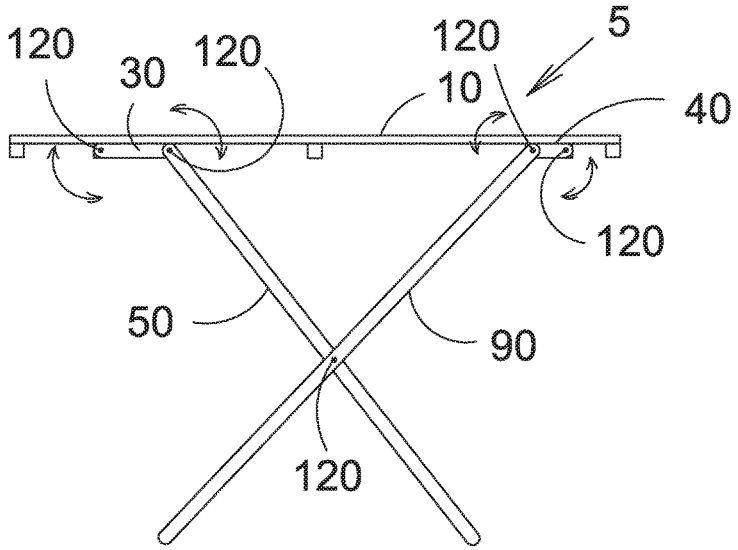
FIG. 2 is a side view of the embodiment and position shown in FIG. 1.
Figure 3:
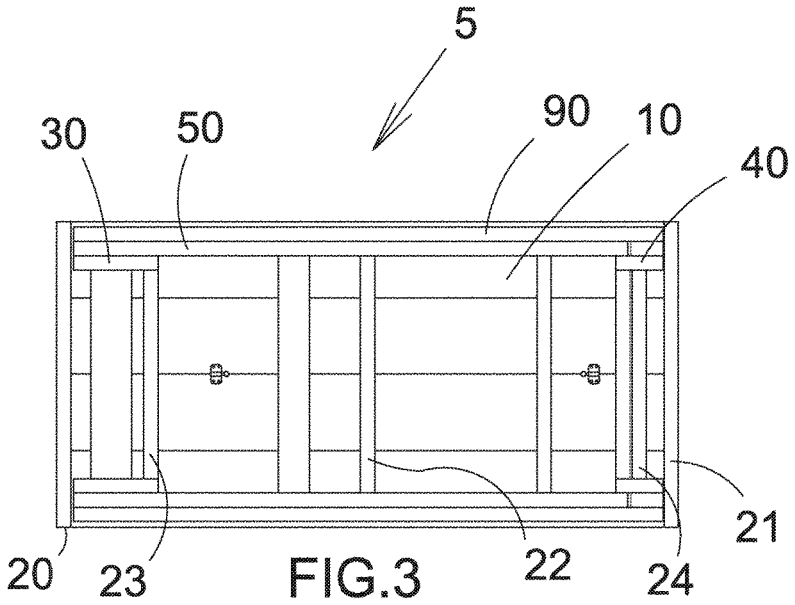
FIG. 3 is a bottom view showing the embodiment illustrated in FIG. 1, but is instead illustrated in a storage position.
Figure 4:
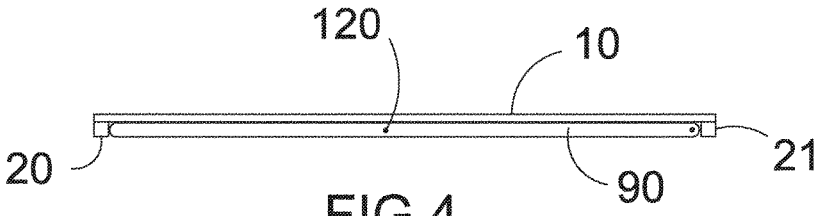
FIG. 4 is a side view of the embodiment illustrated in FIG. 3.

The table has a storage position (FIGS. 3 and 4) and a deployed position (FIGS. 1 and 2).

In the storage position (or collapsed position), the pivot frames 30 and 40 are outward towards the respective ends 20 and 21 of the table. The legs 60, 70, 100 and 110 are flat against the top 10. In this regard, the legs are parallel to each other and parallel to the top. The legs are contained within the outer perimeter of the top 10 when in the storage position. The storage or collapsed position, the overall height of the table can be about 1¼ inch. The lower surfaces of the collapsed legs are generally coplanar with the lower surfaces of the supports 20-24.

In the deployed position (or set up position), the pivot frames 30 and 40 are pivoted inwards towards the center support 22. The legs 60 and 70 cross legs 100 and 110 at the pivot connections. The respective distal ends of the legs have distance between them. The midpoint between the leg separation distance is generally aligned with the top midpoint. The point of pivotal connection between the legs is not aligned with the top midpoint and the leg separation midpoint. This is due to the outer legs being longer than the center legs. The overall height of the table 5 when set up is preferably about 25 inches. Yet, the table could be taller or shorter without departing from the broad aspects of the present invention.

The pivot frames 30 and 40 swing approximately 180 degrees moving from the storage position to the deployed position. The proximal ends of the legs orbit in paths defined by the respective swinging frames. The orbit radii are respectively defined by the distance between the fasteners on the respective pivot frames 30 and 40. The orbit path radius of outer legs 90 is shorter than the orbit path radius of the center leg frame 50 due to the size differences between the respective pivot frames.

From a side profile, it is seen that there are five pivotally connected components (10 total fasteners) that cooperate to move the table to and from (and to be in) the storage and deployed positions.

Thus it is apparent that there has been provided, in accordance with the invention, an invention that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A table comprising:

a top with a top first end and a top second end;

a first pivot frame pivotally connected to said top near said top first end;

a second pivot frame pivotally connected to said top near said top second end;

a center leg frame pivotally connected to said first pivot frame; and a first outer leg and a second outer leg, each of said first outer leg and said second outer leg being pivotally connected to said second pivot frame, and said first outer leg and said second outer leg each being pivotally connected to said center leg frame.

2. The table of claim 1 wherein said top has a first pivot support and a second pivot support, said first pivot frame being pivotally connected to said first pivot support and said second pivot frame being pivotally connected to said second pivot support.

3. The table of claim 2 wherein:

said first pivot frame is rotatable approximately 180 degrees relative to said first pivot support; and said second pivot frame is rotatable approximately 180 degrees relative to said second pivot support.

4. The table of claim 3 wherein:

said table has a storage position;

said top has a first end support;

said first pivot frame being between said first end support and said first pivot support when said table is in said storage position.

5. The table of claim 4 wherein:

said table has a deployed position;

said top has a center support; and said first pivot frame being between said center support and said first pivot support when said table is in said deployed position.

6. The table of claim 5 wherein said first outer leg has a first outer leg proximal end, said first outer leg proximal end moving in an orbital path between said storage position and said deployed position as said second pivot frame pivots about said second pivot support.

7. The table of claim 1 wherein:

said center leg frame has a first leg and a second leg each with a center leg frame leg length;

said first outer leg and said second outer leg each have an outer leg length; and said outer leg length is longer than said center leg frame leg length.

8. The table of claim 1 wherein:

said top has a top midpoint said center leg frame has a center leg frame first leg with a center leg frame first leg distal end, and a center leg frame second leg with a center leg frame second leg distal end; and said first outer leg has a first outer leg distal end and said second outer leg has a second outer leg distal end;

when in a deployed position, said center leg frame first leg distal end is separated from said first outer leg distal end by a separation distance having a separation midpoint; and said separation midpoint is vertically aligned with said top midpoint.

9. The table of claim 8 wherein said center leg frame first leg is pivotally connected to said first outer leg at a leg connection point, said leg connection point not being vertically aligned with said separation midpoint and said top midpoint.

10. The table of claim 1 wherein:

said first pivot frame has a first pivot frame web;

said second pivot frame has a second pivot frame web; and said first pivot frame web is generally parallel to said second pivot frame web.

11. The table of claim 1 wherein said top further comprises a first lock and a second lock, said first lock and said second lock selectably locking said first pivot frame and said second pivot frame in a deployed position.

12. A table comprising:

a top having a top midpoint, a top first end and a top second end;

a first pivot frame connected to said top between said top midpoint and said top first end;

a second pivot frame connected to said top between said top midpoint and said top second end;

a center leg frame having a first center leg with a first center leg distal end, and a second center leg with a second center leg distal end, said center leg frame is pivotally connected to said first pivot frame; and a first outer leg having a first outer leg distal end and a second outer leg having a second outer leg distal end, each of said first outer leg and said second outer leg are pivotally connected to said second pivot frame, wherein:

said table has a storage position and a deployed position;

when said table is in said deployed position, a distance between said first outer leg distal end and said first center leg distal end has a leg midpoint, said leg midpoint being generally vertically aligned with said top midpoint; and said first outer leg is longer than said first center leg.

13. The table of claim 12 wherein:

said top has a top length;

said first center leg and said second center leg each have a center leg length;

said first outer leg and said second outer leg each have an outer leg length; and said outer leg length and said center leg length are each shorter than said top length.

14. The table of claim 12 wherein:

said first center leg is pivotally connected to said first outer leg; and said second center leg is pivotally connected to said second outer leg.

15. A table comprising:

a top with a top first end and a top second end;

a first pivot frame connected to said top near said top first end and pivotable with respect to said top approximately 180 degrees;

a second pivot frame connected to said top near said top second end and pivotable with respect to said top approximately 180 degrees;

a center leg frame pivotally connected to said first pivot frame; and a first outer leg and a second outer leg, each of said first outer leg and said second outer leg being pivotally connected to said second pivot frame, and said first outer leg and said second outer leg being pivotally connected to said center leg frame, wherein said table has a storage position and a deployed position, said first pivot frame and said second pivot frame each lying in a plane generally parallel to said top when in said storage position and in said deployed position as said first pivot frame and said second pivot frame each pivot approximately 180 degrees relative to said top when said table is moving from said storage position to said deployed position.

16. The table of claim 15 wherein:

said top has a first pivot support, said first pivot frame being pivotally connected to said first pivot support;

said top has a second pivot support, said second pivot frame being pivotally connected to said second pivot support;

said center leg frame has a first center leg with a first center leg proximal end and a second center leg with a second center leg proximal end;

said first outer leg has a first outer leg proximal end and said second outer leg has a second outer leg proximal end;

said first center leg proximal end and said second center leg proximal end pass in an orbital path about said first pivot support when said table is moving from said storage position to said deployed position; and said first outer leg proximal end and said second outer leg proximal end pass in an orbital path about said second pivot support when said table is moving from said storage position to said deployed position.

17. The table of claim 16 wherein:

said top has a top midpoint;

said first center leg has a first center leg distal end and said second center leg has a second center leg distal end;

said first outer leg has a first outer leg distal end and said second outer leg has a second outer leg distal end;

when said table is in said deployed position, a distance between said first center leg distal end and said first outer leg distal end has a deployed midpoint, said deployed midpoint being generally vertically aligned with said top midpoint.

18. The table of claim 16 wherein, in said storage position, said first center leg, said second center leg, said first outer leg and said second outer leg are each generally parallel with said top.

* * * * *